US007454869B2

(12) United States Patent
Owen

(10) Patent No.: US 7,454,869 B2
(45) Date of Patent: Nov. 25, 2008

(54) RAISED FLOORING SYSTEM AND METHOD

(76) Inventor: David D. Owen, 9 Sagebush La., Hilton Head, SC (US) 29926

( * ) Notice: Subject to any disclaimer, the term of this patent is extended or adjusted under 35 U.S.C. 154(b) by 310 days.

(21) Appl. No.: 11/365,416

(22) Filed: Mar. 1, 2006

(65) Prior Publication Data

US 2007/0204539 A1 Sep. 6, 2007

(51) Int. Cl.

| | |
|---|---|
| ***E04B 1/00*** | (2006.01) |
| ***E04B 2/82*** | (2006.01) |
| ***E04B 9/00*** | (2006.01) |
| ***E04G 1/22*** | (2006.01) |
| ***E04C 2/52*** | (2006.01) |

(52) U.S. Cl. ..... 52/263; 52/126.1; 52/126.4; 52/126.6; 52/220.1

(58) Field of Classification Search ..... 52/126.4, 52/126.6, 126.1, 220.1, 263
See application file for complete search history.

(56) References Cited

U.S. PATENT DOCUMENTS

| | | | | | |
|---|---|---|---|---|---|
| 4,484,426 | A | * | 11/1984 | Simms | 52/239 |
| 4,558,544 | A | * | 12/1985 | Albrecht et al. | 52/126.6 |
| 5,245,805 | A | * | 9/1993 | Takeda et al. | 52/126.6 |
| 5,333,423 | A | * | 8/1994 | Propst | 52/126.6 |
| 5,442,882 | A | * | 8/1995 | Repasky | 52/105 |
| 5,477,649 | A | * | 12/1995 | Bessert | 52/263 |
| 5,479,745 | A | * | 1/1996 | Kawai et al. | 52/126.6 |
| 5,501,754 | A | * | 3/1996 | Hiraguri | 156/71 |
| RE35,369 | E | * | 11/1996 | Ducroux et al. | 52/126.6 |
| 5,791,096 | A | * | 8/1998 | Chen | 52/126.6 |
| 6,061,982 | A | * | 5/2000 | Owen | 52/220.1 |
| 6,370,831 | B1 | * | 4/2002 | Marshall et al. | 52/263 |
| 6,508,037 | B1 | * | 1/2003 | Owen | 52/220.1 |
| 6,857,230 | B2 | * | 2/2005 | Owen | 52/126.6 |
| 6,918,217 | B2 | * | 7/2005 | Jakob-Bamberg et al. | 52/263 |
| 2003/0177723 | A1 | * | 9/2003 | Jakob-Bamberg et al. | 52/263 |
| 2004/0139671 | A1 | * | 7/2004 | Owen | 52/263 |
| 2005/0235589 | A1 | * | 10/2005 | Jakob-Bamberg et al. | 52/263 |
| 2006/0248814 | A1 | * | 11/2006 | Chen et al. | 52/126.6 |

* cited by examiner

*Primary Examiner*—Richard E Chilcot, Jr.
*Assistant Examiner*—Andrew J Triggs
(74) *Attorney, Agent, or Firm*—Tarolli, Sundheim, Covell & Tummino LLP

(57) ABSTRACT

A raised flooring system having a sub-work surface is disclosed. The system includes a plurality of pedestal assemblies, a plurality of base floor pads for placing and securing the pedestal assemblies, and a locking assembly for securing the pedestal assemblies to the base floor pads. The locking assemblies include a plurality of projections extending from the pedestal assemblies, a receiving aperture located in each of the base floor pads for receiving the projections in a first position, and a locking aperture in communication with the receiving aperture for locking the pedestal when in a second position to relative to the base floor pad. Inserting the projections into the receiving apertures and rotating the pedestals from the first position to a second position secure the pedestals to the base floor pads, one to another, thus providing exact registration of the pedestals for the ultimate installation of the work floor panels.

9 Claims, 5 Drawing Sheets

RAISED FLOORING SYSTEM AND METHOD

FIELD OF THE INVENTION

This invention relates to an accessible raised floor system for use in office buildings or the like, and more specifically, a locking floor system designed for quick assembly.

BACKGROUND OF THE INVENTION

Historically, building owners have not had to deal with tenant requirements for supplemental cooling, power and cabling, with the exception of special purpose computer or trading rooms. These special purpose rooms have been dealt with almost as if they were separate structures. Unless a building was occupant owned, a tenant had to deal with these requirements. Now, due to the changes in market economies, frequently landlords are forced to solve problems of substantial increases in power requirements, additional cooling and cable distribution.

As the use of office space has evolved since the development of personal computers (PC), there has been an escalation in the need for and frequency of re-organization and re-configuration of office space. Enormous amounts of effort and study have gone into the planning and design of office space in order to render its use more flexible and sympathetic to user functions. Most of these efforts have been concentrated in modular space planning and systems furniture engineered to accommodate PCs.

Modem day office requirements have placed burdens on heating/cooling, electrical power distribution and cabling systems which were never anticipated when even the most modern office buildings were built. The rates of reorganization and reconfiguration have escalated from about 10% to 15% per year, U.S. averages in the early 1990's, to 35% to 50% in the mid 1990's, with some companies and industries exceeding 100% per year. The technological life expectancy of local and wide area networks cabling and connectors is currently about eighteen months to two years.

Physical concentrations of PCs and other electrical enhancements such as facsimile machines, copiers, printers, scanners, and in particular, the personnel operating the equipment, have placed extra-ordinary burdens on the most sophisticated and powerful heating, ventilating and air conditioning systems. These concentrations of equipment and personnel generated heat are most frequently offset by increasing the velocity of chilled air from overhead diffusers, usually at the expense of other areas, and to the discomfort of personnel.

Traditionally and technically there have been roughly seven predominant methods of distributing heating/cooling, electrical power and cable in horizontal planes from vertical sources, whether from a building core or from other vertical chases. They have been:

1) Through a ceiling plenum;

2) Through the use of conventional raised flooring systems, as have been used in computer rooms;

3) In-floor conduits or proprietary ducts;

4) A combination of plenum and under-floor distribution through rigid conduit into poke-through outlet boxes to the floor above;

5) Through stud and drywall partitions and/or column enclosures;

6) Through power poles; and,

7) Through system furniture panels.

All of these systems require the feeding of electrical power wiring and cabling through studding, systems furniture, in-floor conduit or ducts. Convenient, horizontal retro-feeding of electrical power wiring or cabling through finished stud and dry wall partitions is particularly difficult, costly, disruptive and sometimes, impossible unless sufficient conduit has been pre-installed.

The most flexible and common of these systems has been the use of ceiling plenums. This plenum approach has severe difficulties and limitations. All work must be performed from ladders or scaffolding. Most connections to work surfaces must be through stud and dry wall partitions or so-called power poles vertically to work surface or floor levels and then distributed horizontally using more stud and dry wall partitions, systems furniture or in-floor conduit or duct.

Once additional power is in place, an undesirable result is a comparable increase in generated heat, requiring more cooling. Typically such additional heat loads have not been anticipated nor dealt with in the base building design or construction.

Localized cooling solutions are being dealt with by trying to increase the output of existing systems such as pushing more air by using higher blower velocities. Increases in air velocities result in increased noise levels and are really nothing more than cycling air more rapidly through the base system which has a finite heat absorbing capacity.

There have been proposals for retrofitted auxiliary flooring systems all of which suffer distinct disadvantages. With one proposal, a lower forced air plenum would be provided for conducting supplemental cooling air to a workspace where heat generating electronic equipment has been installed. Other flooring components would be formed to define enclosed ducts above the air plenum for power cables and communication conductors. It is necessary that these enclosed ducts have imperforate walls to prevent spread of an electrical fire. In the event of such a fire, the egress of the supplemental conditioning air from the plenum would obviously be undesirable. It is for these reasons that building codes require all wiring be encased in fire resistant conduit.

Prior proposals for supplemental flooring systems have all been excessively complex such that they required skilled installers for disproportionately long periods of time. Further, prior proposed systems have not been fully modular and had inadequate provision for access to service lines extending through such a system.

Simple to install supplemental flooring systems which will accommodate power cable, communication wiring, and supplemental cooling to meet the demands of both current day and future electronic equipment are described and claimed in Applicant's U.S. Pat. No. 6,061,982 issued May 16, 2000; U.S. Pat. No. 6,508,037 issued Jan. 21, 2003; and U.S. Pat. No. 6,857,230 issued Feb. 22, 2005, each entitled Raised Flooring System & Method and each is incorporated herein by reference. As systems described in the patents have been developed, a need has evolved for a more economical and expeditious setup floor panel assembly having an increased forgiveness to deviations in panel orientation and in cumulative tolerances for attachment. In addition, a need has developed for increasing the structural integrity of the floor systems by providing a locking method and apparatus that allows for quick assembly, yet more secure and resistant to racking and forces imposed on the system.

SUMMARY OF THE INVENTION

The present disclosure is directed to a raised flooring system method and apparatus having an enhanced structural design providing greater structural integrity to the system as well provides a design for faster assembly. In one embodiment, the system provides a plurality of pedestal assemblies and base floor pads for placing and securing the pedestal assemblies. The system further includes a locking assembly for securing the pedestal assemblies to the base floor pads where the locking assemblies include a plurality of projections extending from the pedestal assemblies, receiving apertures located in each of the base floor pads for receiving the projections, and locking apertures in communication with the receiving apertures for locking the pedestals to the base floor pads. Each of the pedestals includes a cap defining a work floor support surface for support of work floor panels. By inserting the projections into the receiving apertures and rotating the pedestals, advances the projections into the locking apertures thereby securing the pedestals to the base floor pads.

In an exemplary embodiment, the projections include a recess for aiding an enhanced setup process. The recess contains a wedge profile that aids in guiding the pedestal projections into corresponding receiving slots found within the base floor pads. The recess configuration in conjunction with the twist-and-lock system also assists in relaxing the individual and cumulative tolerance requirements between base floor pads. Because the receiving slot provides a larger opening than the corresponding size of the projection, less readjustment or disassembly is required because of improper base floor pad orientation, configuration, and the like. The projection recess further relaxes the overall tolerances as well aids in positioning the projection within the penetrating or receiving slot of the base floor pad.

Additional advantages of the disclosed locking system allows an assembler to quickly place the base floor pads throughout any room requiring a raised floor assembly. The lightweight design and enhanced tolerance allotment allows the pads to be easily and expeditiously maneuvered into position. The pedestals are then placed into corresponding slots located within each of the base floor pads. By turning the pedestals, a locking position is acquired, which guarantees that the pedestal caps are in the proper location for receiving the much heavier and more difficult to maneuver work floor panels. A work floor panel depending on the application can be made from any number of materials, including wood, aluminum, stone, or most commonly, a steel pan filled with approximately one-inch of concrete. Therefore, the importance of proper pedestal positioning should be appreciated when it results in the successful positioning of a two-foot by two-foot steel square filled with one-inch thick concrete.

The locking construction therefore provides reassurance to even an unskilled assembler that the positions between pedestals are properly located for the installation of the work floor panels. In addition, the increased tolerances in the locking assembly construct reduces, if not eliminates the need to reposition the base floor pads, thus saving time and money.

In yet another embodiment, the projections comprise an angle complementary to the locking aperture surface profile. In one embodiment the angle is 45 degrees reducing the tendency for movement in the flooring system resulting from racking or axial forces. Another feature of the flooring system is extending the projection profile along the length of the locking aperture to further strengthen the system against undesirable forces.

In yet another feature of the raised flooring system includes a locking assembly comprised of a pedestal having a foot or locking projections made from a rigid material such as plastic to further resist racking or axial loading of the pedestals. In one embodiment the rigid material is metal based such as cast aluminum.

Another feature of the flooring system is the addition of an adhesive member to the cap portion of the pedestals. The adhesive member then attaches to an underside of the work floor panels. The adhesive members aid in reducing lateral movement of the working floor panels as well enhances the overall system's structural integrity.

In yet another exemplary embodiment introduces stabilizing pedestals for providing additional support to the working floor panels in areas requiring additional support. The pedestals can be positioned within the base floor pad apertures, thereby requiring little if any adjustment to a leveling assembly within the pedestal. Alternatively, the stabilizing pedestals can be positioned on the work floor pads typically requiring an adjustment the pedestal leveling assembly.

These and other advantages and features of the exemplary embodiment of the raised floor assembly are described in detail in conjunction with the accompanying drawings.

DETAILED DESCRIPTION OF THE PREFERRED EMBODIMENTS

Figure 1:
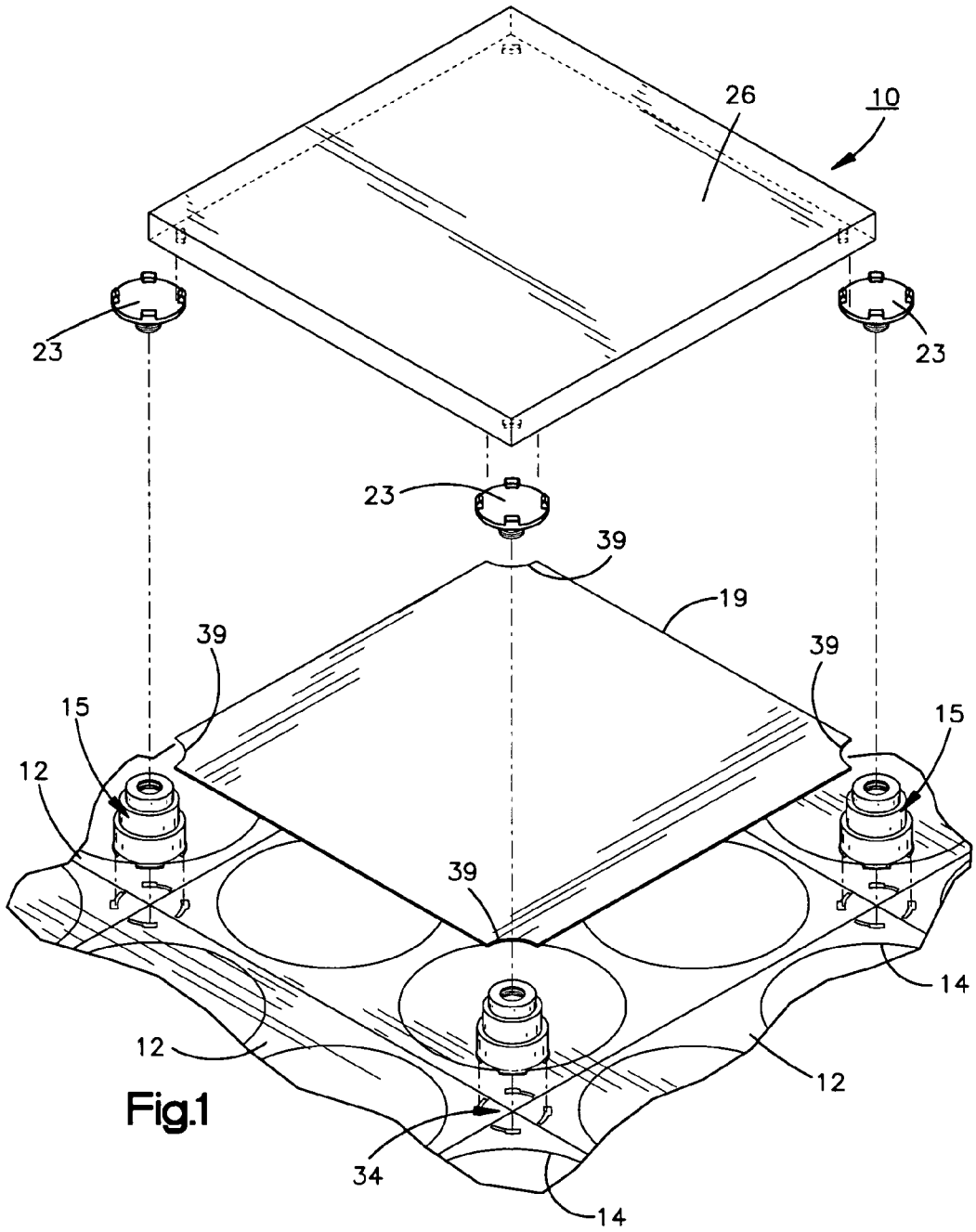
FIG. 1 is a fragmentary perspective view of a portion of a flooring system made in accordance with one embodiment.

Referring to the drawings and to FIG. 1 in particular, a fragmentary portion of an assembled flooring system utilizing plastic or metal components is shown generally at 10. A plurality of base floor pads 12 make a first level of the assembly 10. Each base floor pad has four relatively large through apertures 14 which are provided to minimize weight and material consumed and to provide for the flexible positioning of stabilizing pedestals 13 discussed later in detail.

Figure 2A:
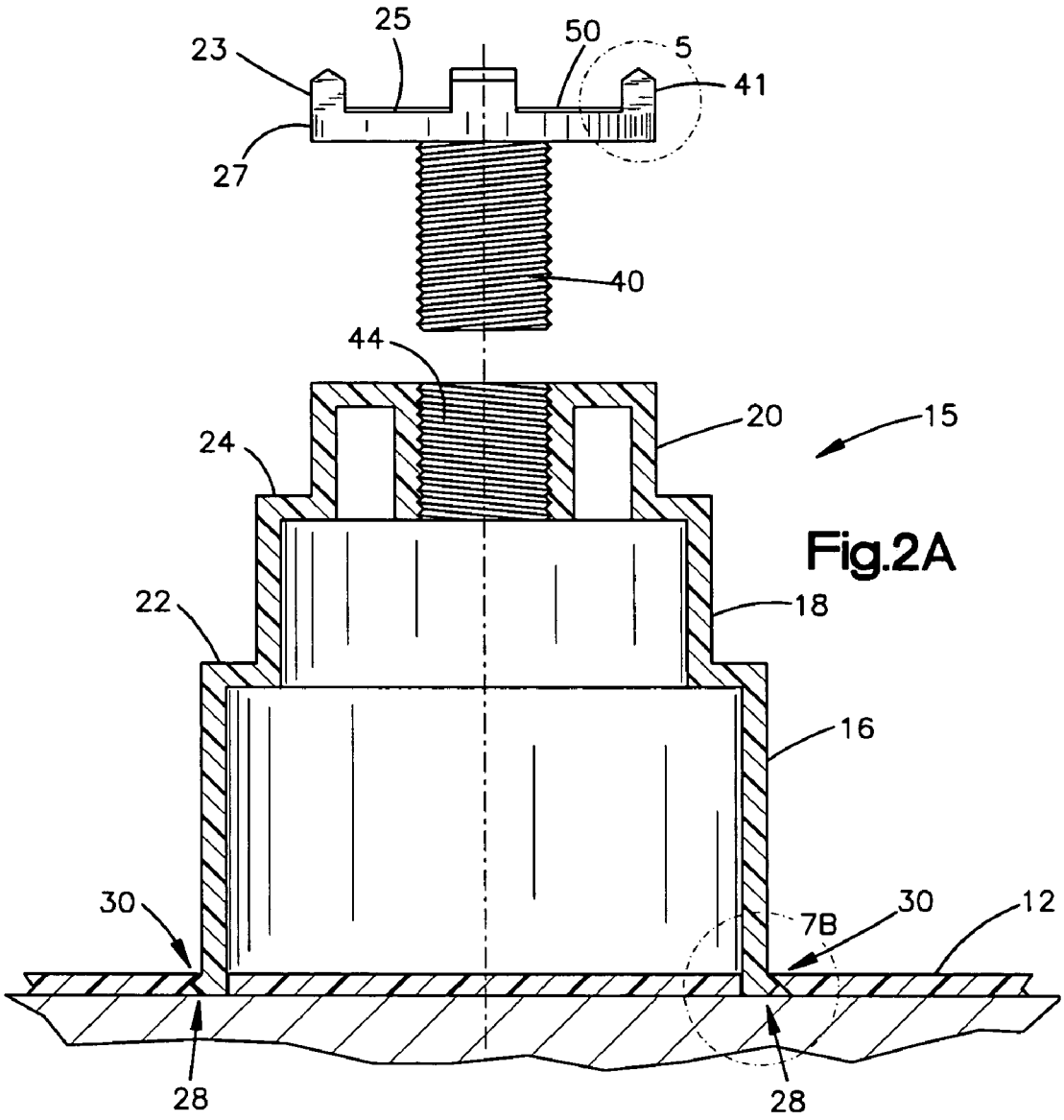
FIG. 2A is an enlarged sectional view of a pedestal and a threaded cap used with the flooring system with engaging projections.
Figure 2B:
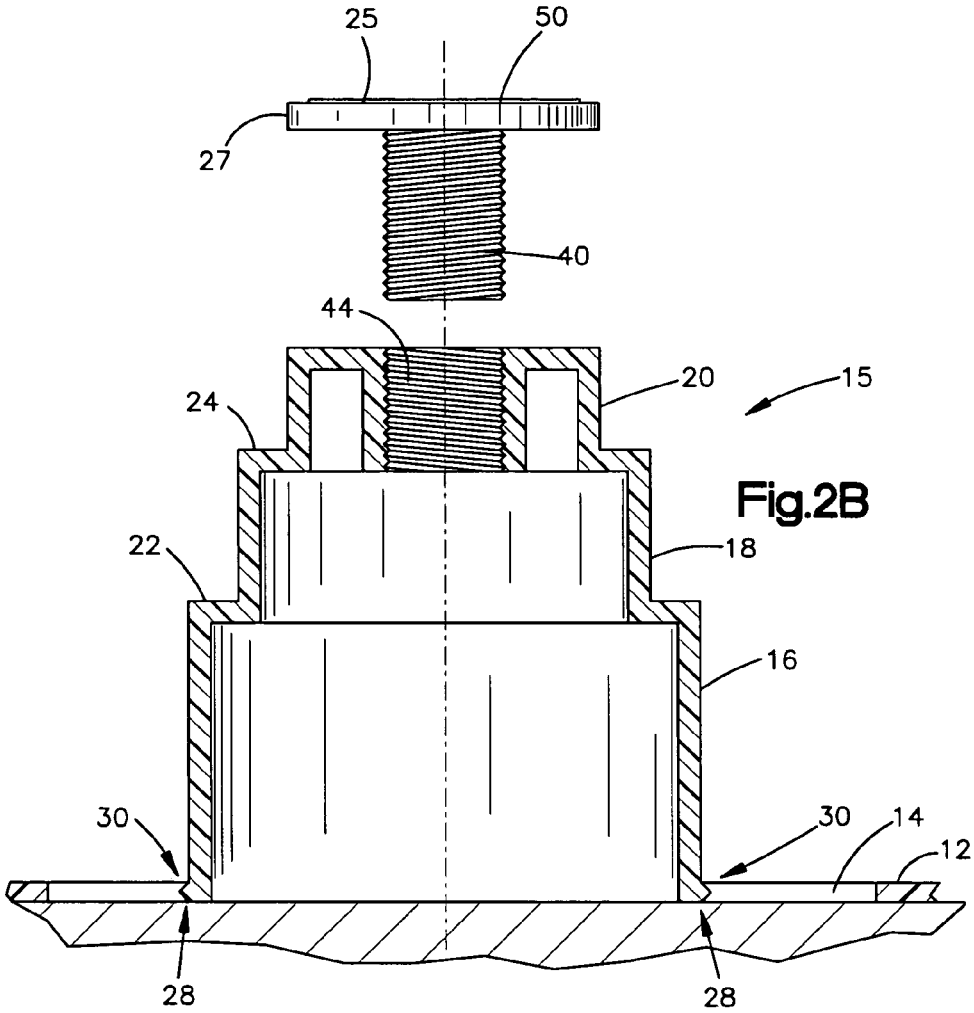
FIG. 2B is an enlarged sectional view of a stabilizing pedestal and a threaded cap used with the flooring system.

Also shown in FIG. 1 is a plurality of pedestals 15. The pedestals include base, central and top conical segments 16, 18, and 20, as depicted in FIGS. 2A and 2B. The conical segments are axially aligned and contiguous to define support surfaces for separation plates. More specifically, a first annular surface 22, which is flat and horizontal when in use, interconnects a base and central segments for supporting a lower separator plate 17 at a second level shown in FIG. 4B. Similarly, at a third level, an upper separator plate 19 at FIG. 4B resides on a second flat annular surface 24 that interconnects the central and top segments 18 and 20 of pedestals 15, as show in FIG. 4B. Both the upper and lower separator plates are optional based on the application of the floor assembly 10 and the particular desire to divide cables, piping, and other articles therein.

The upper and lower separator plates are each flat and made from plastic or metal sheets with corner cutouts to receive appropriate portions of the pedestals 15. The separator plates 17 and 19 have corner cutouts 39, each of which constitutes a quarter of a circle such that four adjacent panels collectively are capable of surrounding a central conical segment 18 of a single pedestal 15.

Pedestal caps 23 are threaded for engaging the top the pedestals 15, and provide a flat top surfaces 25, which function as support surfaces for work floor panels 26 that make up a fourth and top level, as shown in FIG. 1. Referring now to FIG. 2A, the cap 23 shown there has a threaded stem 40 projecting downwardly from a work floor support disc 27. Each pedestal 15 has a threaded, axial bore 44 extending downwardly from a flat, annular, top surface. The stem, when in use, threads into the bore 44 for leveling adjustment of work floor panel(s) resting atop the support disc 27. Each cap 23 in a typical pedestal 15 will contain four upstanding projections 41 for locking engagement with complemental apertures in supported work floor panel(s) 26 as shown in FIG. 1.

Figure 4A:
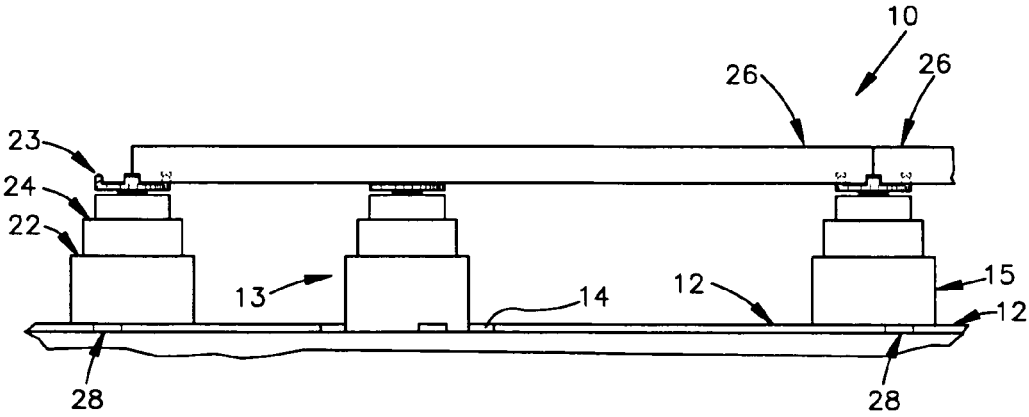
FIG. 4A is an elevated view of another flooring system embodiment depicting base floor pads and work floor panels supported by a pair of pedestals plus a stabilizing pedestal.
Figure 4B:
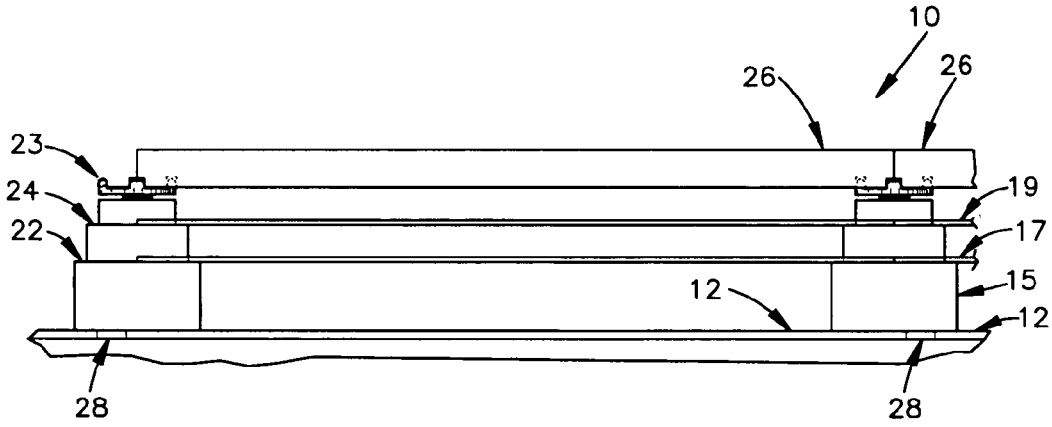
FIG. 4B is an elevated view of another flooring system embodiment depicting base floor pads, separation plates, and work floor panels supported by a pair of pedestals.
Figure 5:
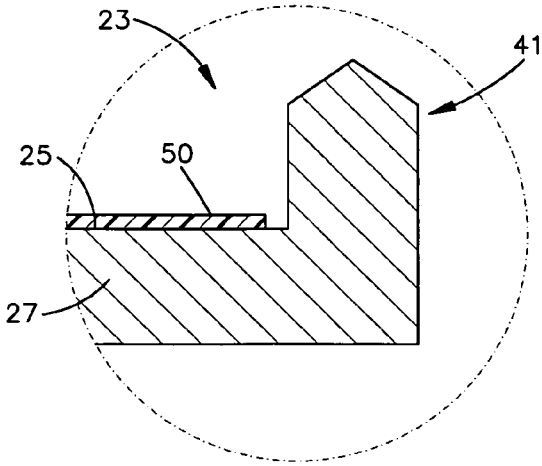
FIG. 5 is a magnified view of a pedestal cap of FIG. 2A.

Alternatively, the stabilizing pedestal 13 shown in FIG. 2B comprises only a flat pedestal surface 25 and is without projections 41. The stabilizing pedestal(s) 13 can be used at any location requiring additional support to work floor panel 26. In one embodiment, the separation plates 17 and 19 are removed for positioning of the stabilizing pedestals, as shown in FIG. 4A. In either of the aforementioned embodiments, the stabilizing pedestal height can be adjusted through corresponding stem 40 and axial bore 44 as needed. If the stabilizing pedestal is located within an aperture 14, typically no height adjustment would be required.

Figure 3:
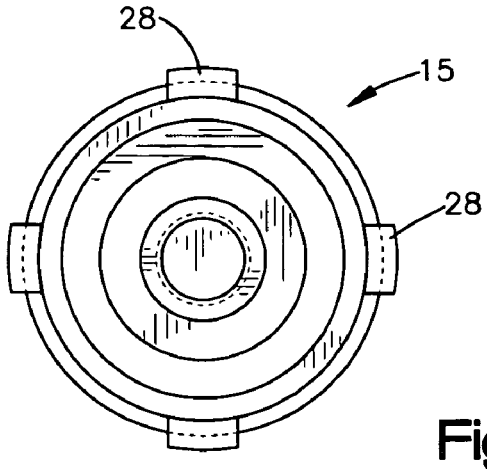
FIG. 3 is a bottom view of the pedestal shown in FIG. 2A.
Figure 7A:
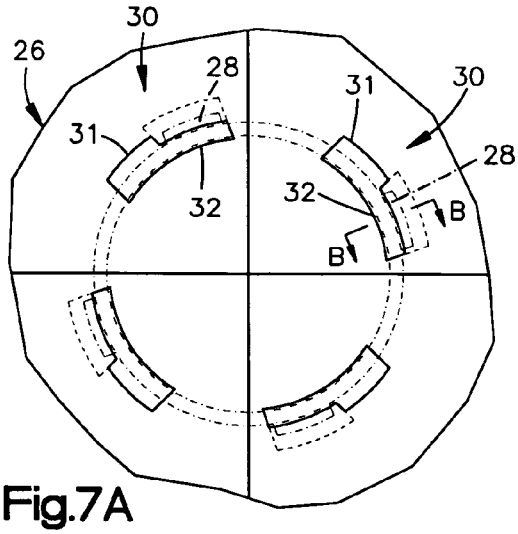
FIG. 7A is a plan view shown through an array of work floor panels depicting the pedestal feet positioned in the locking portion of the base floor pads; and, FIG. 7B is a section view of the pedestal feet of FIG. 7A, where the feet are positioned in the locking portion of the base floor pads.
Figure 7B:
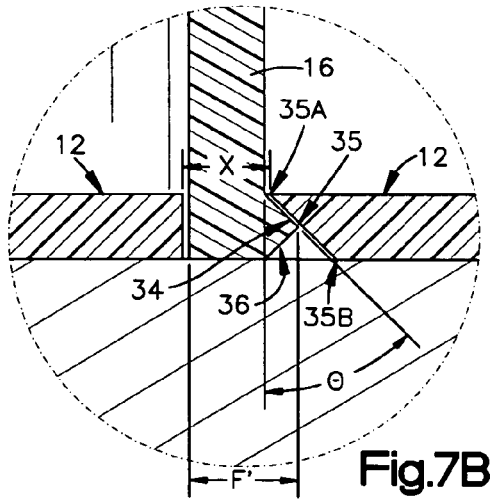

Referring again to FIG. 2A and now FIGS. 3 and 7B, each pedestal 15 includes four depending feet 28 extending downwardly from the base segment 16. The feet are of a vertical dimension equal to the thickness of the base floor pads 12, and in this embodiment, the pads and feet are approximately ¼" thick. The pedestals 15 are mounted along the corners of an array of base floor pads 12, and will engage one, two, three, or four base floor pads and it is possible that one, two, three or all four of the particular pedestal feet will be outboard of the array. Since the feet have a vertical height equal to the thickness of the pads, the outboard feet will engage the supporting building floor and maintain the pedestals in a vertical orientation.

Figure 6A:
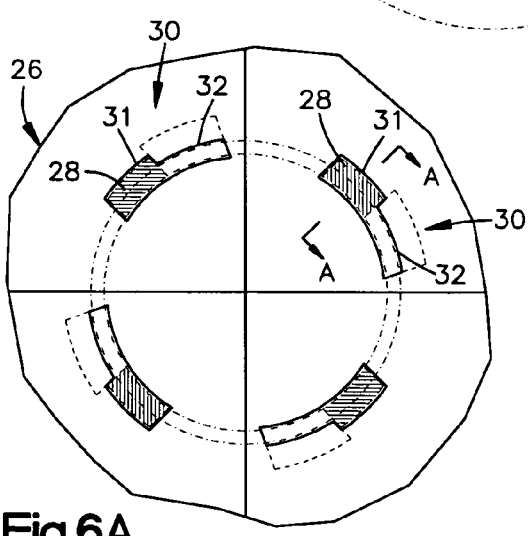
FIG. 6A is a plan view shown through an array of work floor panels depicting pedestal feet positioned in a penetrating portion of the base floor pads.
Figure 6B:
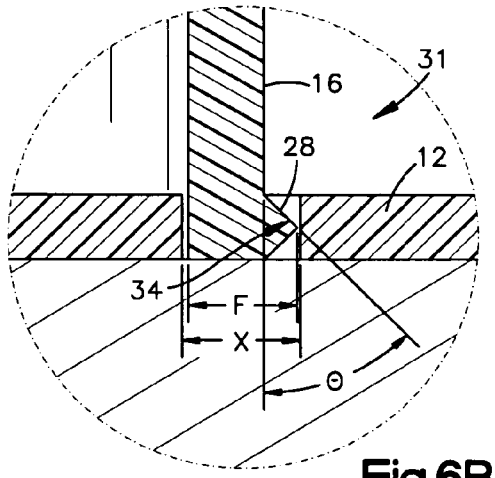
FIG. 6B is a section view of the pedestal feet of FIG. 6A, where the feet are positioned in the penetrating portion of the base floor pads.

Shown in FIGS. 6-8, each pedestal foot 28 communicates with a corresponding slot 30 located within base floor pad(s) 12. Each slot 30 has a penetrating portion 31 depicted by Section A-A in FIG. 6A, where the width of the penetrating portion 31 represented by dimension "X" and is greater than the width of the corresponding foot 28 represented by dimension "F", as shown in FIG. 6B. The pedestal 15 is then secured from racking or other forces by rotating the pedestal 15 relative to the base floor pad 12 from a first unlocked position of FIGS. 6A-6B to locking position depicted in FIGS. 7A-7B, where each pedestal foot 28 is retained by a locking portions 32 located within base floor pad slot 30. Referring now to FIGS. 7A-7B, it can be seen that the width of the locking portion 32 represented by dimension "X" is less than the width of the corresponding foot represented by dimension "F'".

While the Applicant's prior flooring systems having a snap connection between the pedestals and base floor pads represented an advancement in the prior art, the present invention's locking configuration is a significant improvement. Such construct between the feet 28 and slots 30 provides several novel advantages of the claimed disclosure. One advantage is an increase in the amount of locking surface area between the foot 28 and the locking portion 31, as shown in FIG. 7B, making the assembly 10 more secure and less susceptible to racking or shifting. Facilitating such security is a contacting surface 34 of foot 28 positioned at an angle Θ, illustrated in this embodiment to be 45-degrees and complementary to a 45-degree securing surface 35 of the base floor pad 12. The securing surface 35 provides both a proximal end 35A and distal end 35B. The combination of both the 45-degree configuration of the contacting and securing surfaces, as well penetrating portion 31 narrowing to the locking portions 32 allow for the enhanced locking geometry depicted in FIG. 7B. Such configuration permits the proximal end 35A of the securing surface to provide a significant coverage over the contacting surface 34, increasing the base floor pads holding strength on the pedestals. Depending on the amount of forces imposed on the floor, the angle Θ in the feet 28 can be increased for more security. Alternatively, the angle Θ can be decreased thereby relaxing the overall cumulative tolerances in the floor assembly.

Another advantage of the current twist-and-lock configuration is the ease of setup and disassembly over the prior art. The with a snap-type connection the cumulative tolerances between base floor pads were very small, only a few thousands of an inch, allowing little if any deviation in tolerance or spacing between base floor pads in order to snap the pedestals into the base floor pad. The twist-and-lock structure permits higher individual and cumulative tolerances in the spacing between base floor pads 12, since the penetrating portions 31 are oversized relative to the size of the foot 28. For example, the twist-and-lock connection can allow for 0.25" tolerances between pads, which is much greater than the few thousands of an inch tolerance allowed by the snap-type connection assemblies. The current assembly's enhanced user-friendly configuration over the snap-type connection allows the base floor pad to be used more like a jig for quick placement and removal of pedestals 15.

Yet another advantage is that the foot material is no longer limited to flexible "snap-like material", but can be made from harder materials, including metals. In addition, the cumulative tolerances are capable of being further relaxed because of a recess 36 designed in the foot 28, as shown in FIG. 7B. By adding the recess 36, the contacting surface 34 is less likely to encounter an interference connection with securing surface 35 when engaging the penetrating portion 31 of slot 30. Moreover, the wedge profile in the recess 36 facilitates quick insertion of the feet 28 into the penetrating portions 31, since it naturally positions the feet in a guide-like fashion about corresponding slots 30. The guide-like feature is even more helpful when two, three, or even four feet 28 are required to be positioned within multiple base floor pads 12, as in the illustrated embodiment where a pedestal 15 is shown in FIG. 1 to be mounted at the juncture of four corners at 34.

In an additional embodiment, the flat cap surface 25 of caps 23 for the pedestal 15 and/or stabilizing pedestals 13 contain an adhesive member 50, as depicted in FIGS. 2A-2B. The adhesive member 50 coactingly attaches with the underside of work floor panel 26. In one embodiment, the adhesive member is double-sided tape. In another embodiment, the adhesive member results from the application of an adhesive compound. The addition of the adhesive member 50 helps reduce any lateral movement of the work floor panel(s) 26, as well adds to the overall structural integrity of the floor assembly 10.

Although the invention has been described in its preferred form with a certain degree of particularity, it is understood that the present disclosure of the preferred form has been made only by way of example and that numerous changes in the details of construction, operation and the combination and arrangement of parts may be resorted to without departing from the spirit and the scope of the invention as hereinafter claimed.

I claim:

1. A support system having multiple floors of a sub-work surface utility line containment system comprising:

a) a plurality of pedestal assemblies;

b) a plurality of base floor pads for placing and securing said pedestal assemblies, each pedestal assembly connecting at least two base floor pads;

c) a locking assembly for securing each pedestal assembly to at least two of said base floor pads when said pedestal assemblies are positioned about said base floor pads, said locking assembly comprising:

i) a plurality of projections extending from each pedestal assembly;

ii) a receiving aperture forming a first discontinuous opening located in each of said base floor pads for receiving said projections in a first position, the first discontinuous opening being formed from first and second arc; and iii) a locking aperture forming a second discontinuous opening in communication with said receiving aperture for locking said pedestals when in a second position to said base floor pad, said second discontinuous opening being formed from said first arc of said first discontinuous opening and a third arc, the third arc being smaller than said second arc such that the locking aperture comprises a smaller opening than said receiving aperture, inserting said projections into said receiving apertures and rotating said pedestal assemblies from said first position to a second position rotates said corresponding projections into said locking apertures thereby securing said pedestals to said base floor pads;

d) each of the pedestals includes a cap defining a work floor support surface for support of work floor panels;

e) whereby rotating each of said pedestal assemblies from said first position to a second position in attaching at least two base floor pads forms a jig for self-aligning respective pedestal assemblies for supporting said work floor panels by said pedestal assemblies.

2. The support system of claim 1, wherein a plurality of stabilizing pedestals can be located throughout the underneath of said work floor panels at positions requiring support.

3. The support system of claim 1, wherein said projections further comprise a recess for aiding in inserting said projection into said receiving aperture of the base floor pads.

4. The support system of claim 3, wherein said projections comprise an angle complementary to said locking aperture.

5. The support system of claim 4, wherein said angle is substantially 45 degrees.

6. The support system of claim 1, wherein said projections extend to the length of said locking apertures increasing the systems overall resistance to external forces.

7. The support system of claim 1, wherein said projections are made from a rigid material.

8. The support system of claim 7, wherein said rigid material is a metal.

9. The support system of claim 1, wherein said cap includes an adhesive member for adding structural stability to the system.

* * * * *